US006056415A

United States Patent [19]

Allred, III et al.

[11] Patent Number: 6,056,415

[45] Date of Patent: May 2, 2000

[54] PENLIGHT HAVING LOW MAGNETIC SUSCEPTIBILITY

[75] Inventors: Jimmie B. Allred, III, Skaneateles; Earl R. Holdren, III, Auburn; Richard W. Mott, East Amherst; Charles L. Mozeko, Tonawanda; Jack A. Belstadt; Jeffrey B. Mallon, both of Lockport; Philip Wutz, Williamsville; Michael F. Pyszczek, LeRoy, all of N.Y.

[73] Assignee: Minrad Inc., Buffalo, N.Y.

[21] Appl. No.: 09/057,051

[22] Filed: Apr. 8, 1998

Related U.S. Application Data

[60] Provisional application No. 60/043,649, Apr. 11, 1997.

[51] Int. Cl.[7] ..... F21L 7/00

[52] U.S. Cl. ..... 362/202; 362/204

[58] Field of Search ..... 362/202, 204, 362/205, 118

[56] References Cited

U.S. PATENT DOCUMENTS

| | | | |
|---|---|---|---|
| 310,004 | 12/1884 | Weston . | |
| 485,089 | 10/1892 | Carhart . | |
| 1,067,646 | 7/1913 | Downey . | |
| 1,877,077 | 9/1932 | Stevens . | |
| 2,282,979 | 5/1942 | Murphy | 136/6 |
| 2,459,702 | 1/1949 | Hipwell et al. | 240/10.66 |
| 2,651,763 | 9/1953 | Grimsley | 339/93 |
| 2,864,880 | 12/1958 | Kaye | 136/111 |
| 2,982,807 | 5/1961 | Dassow et al. | 136/173 |
| 3,352,715 | 11/1967 | Zaromb | 136/83 |
| 3,673,000 | 6/1972 | Ruetschi | 429/174 |
| 3,890,498 | 6/1975 | Toth | 240/10.66 |
| 4,053,687 | 10/1977 | Coibion et al. | 429/94 |
| 4,203,150 | 5/1980 | Shamlian | 362/183 |
| 4,237,527 | 12/1980 | Breedlove | 362/189 |
| 4,264,688 | 4/1981 | Catanzarite | 429/163 |
| 4,286,311 | 8/1981 | Maglica | 362/205 |
| 4,318,967 | 3/1982 | Ruetschi | 429/48 |
| 4,595,641 | 6/1986 | Giurtino | 429/1 |
| 4,596,239 | 6/1986 | Bauman | 128/11 |
| 4,607,623 | 8/1986 | Bauman | 128/11 |
| 4,613,926 | 9/1986 | Heitman et al. | 362/32 |
| 4,656,565 | 4/1987 | Maglica | 362/197 |
| 5,104,752 | 4/1992 | Baughman et al. | 429/1 |
| 5,149,598 | 9/1992 | Sunshine | 429/123 |
| 5,173,371 | 12/1992 | Huhndorff et al. | 429/1 |
| 5,194,340 | 3/1993 | Kosako | 429/1 |
| 5,197,796 | 3/1993 | Moore | 363/202 |
| 5,418,087 | 5/1995 | Klein | 429/101 |
| 5,443,924 | 8/1995 | Spellman | 429/65 |
| 5,580,147 | 12/1996 | Salerno | 362/206 |
| 5,593,222 | 1/1997 | Maglica | 326/157 |
| 5,601,359 | 2/1997 | Sharrah | 362/204 |

FOREIGN PATENT DOCUMENTS

| | | | |
|---|---|---|---|
| 0870974A2 | 10/1998 | European Pat. Off. . | |
| 2211924 | 7/1989 | United Kingdom | 362/202 |

OTHER PUBLICATIONS

John Schneck of General Electric Corporate Research and Development Center, Schenectady, New York 12309, entitled "The Role of Magnetic Susceptibility In Magnetic Resonance Imaging: Magnetic Field Compatibility of the First and Second Kinds": Dec. 9, 1993.

*Primary Examiner*—Sandra O'Shea
*Assistant Examiner*—Hargobind S. Sawhney
*Attorney, Agent, or Firm*—Hodgson Russ Andrews Woods & Goodyear LLP

[57] ABSTRACT

A penlight constructed of materials including metal components having very low magnetic susceptibilities is described. The battery powering the penlight lamp is a lithium battery also constructed of materials having low magnetic susceptibilities. The penlight is particularly useful in the vicinity of the strong magnetic field of an MRI scanner.

40 Claims, 3 Drawing Sheets

PENLIGHT HAVING LOW MAGNETIC SUSCEPTIBILITY

CROSS-REFERENCE TO RELATED APPLICATION

The present application is based on provisional application Ser. No. 60/043,649, filed Apr. 11, 1997.

BACKGROUND OF THE INVENTION

1. Field of the Invention

The present invention generally relates to a hand held device. More particularly, the present invention relates to a flashlight, and still more particularly to a penlight that is constructed of materials having relatively low magnetic susceptibilities. This provides the penlight of the present invention as a useful instrument in the vicinity of a magnetic resonance scanner.

2. Prior Art

The prior art is replete with various types of hand held devices such as flashlights made of metal materials that are not useful in the presence of the strong magnetic fields of a magnetic resonance scanner. Examples include U.S. Pat. Nos. 1,067,646 to Downey; 1,877,077 to Stevens; 2,459,702 to Hipwell et al.; 2,651,763 to Grimsley; 3,890,498 to Toth, Sr.; 4,203,150 to Shamlian; 4,237,527 to Breedlove; 4,286,311 to Maglica; 5,593,222 to Maglica; and 5,601,359 to Sharrah et al.

U.S. Pat. No. 4,607,623 to Bauman describes a hand held laryngoscope constructed of non-ferrous materials such as ABS with the electrically conductive portions provided by first applying a thin copper layer to the ABS followed by electroless plating and then electrolytically plating another copper layer to form a conductive layer about 0.5 to 2 mils thick. A thin layer of aluminum is subsequentially applied to the copper coating in those areas intended to be reflective. The batteries powering this device are not further described, but may be of a nickel/cadmium type commonly used for such applications. Nickel/cadmium batteries are not considered to be relatively nonmagnetic and would not be useful with the flashlight of the present invention.

U.S. Pat. Nos. 310,004 to Weston; 485,089 to Carhart; 2,282,979 to Murphy; 3,352,715 to Zaromb; 3,673,000 to Ruetschi and 4,318,967 to Ruetschi disclose anti- or non-magnetic materials in cells or batteries. Additionally, U.S. Pat. Nos. 2,864,880 to Kaye; 2,982,807 to Dassow et al.; 4,053,687 to Coiboin et al.; 4,264,688 to Catanzarite; 4,595,641 to Giutino; 5,104,752 to Baughman et al.; 5,149,598 to Sunshine; 5,173,371 to Huhndorff et al.; 5,194,340 Kasako; 5,418,087 to Klein; and 5,443,924 to Spellman relate to batteries having means for assuring that proper battery polarity is established. However, none of these patents describe power sources that are useful with the hand held device of the present invention because they either include at least some magnetic components, do not have sufficient energy density for extended use or do not have a terminal configuration similar to that of the present invention. U.S. Pat. No. 4,613,926 to Heitman et al. discloses an illuminating assembly for a magnetic resonance imaging (MRI) scanner.

There is needed a flashlight, and particularly a penlight, that is capable of withstanding conditions which exist in close proximity to the strong magnetic field of an MRI scanner. For that purpose, the penlight of the present invention is constructed largely of components having low magnetic susceptibilities. With the ever increasing use of magnetic resonance scanning to aid medical personnel during pre- and post-clinical and surgical procedures, hand held devices such as a flashlight constructed of materials that have as low a magnetic susceptibility as possible are needed to facilitate the completion of the procedure.

SUMMARY OF THE INVENTION

The penlight of the present invention is constructed of materials including metal components such as brass and beryllium copper having very low magnetic susceptibilities. Those parts not made of metal are preferably formed of a non-magnetic thermoplastic material, for example an acetal compound such as DELRIN. The battery powering the penlight lamp is also constructed of materials having low magnetic susceptibilities. Lithium batteries are required for that purpose, and all components such as the casing, terminal leads, current collectors and collector leads, some of which are typically made of nickel in conventional lithium batteries, are constructed of non-magnetic, austenitic stainless steel having a magnetic susceptibility of about 3,520 to $6{,}700\times10^{6}$.

These and other aspects of the present invention will become more apparent to those skilled in the art by reference to the following description and to the appended drawings.

DETAILED DESCRIPTION OF THE INVENTION

As defined in this application, the word "distal" is used to describe that portion of the penlight that extends away from the user holding the handle, and the word "proximal" is used to describe that portion of the penlight that extends toward the user holding the device by the handle.

Figure 1:
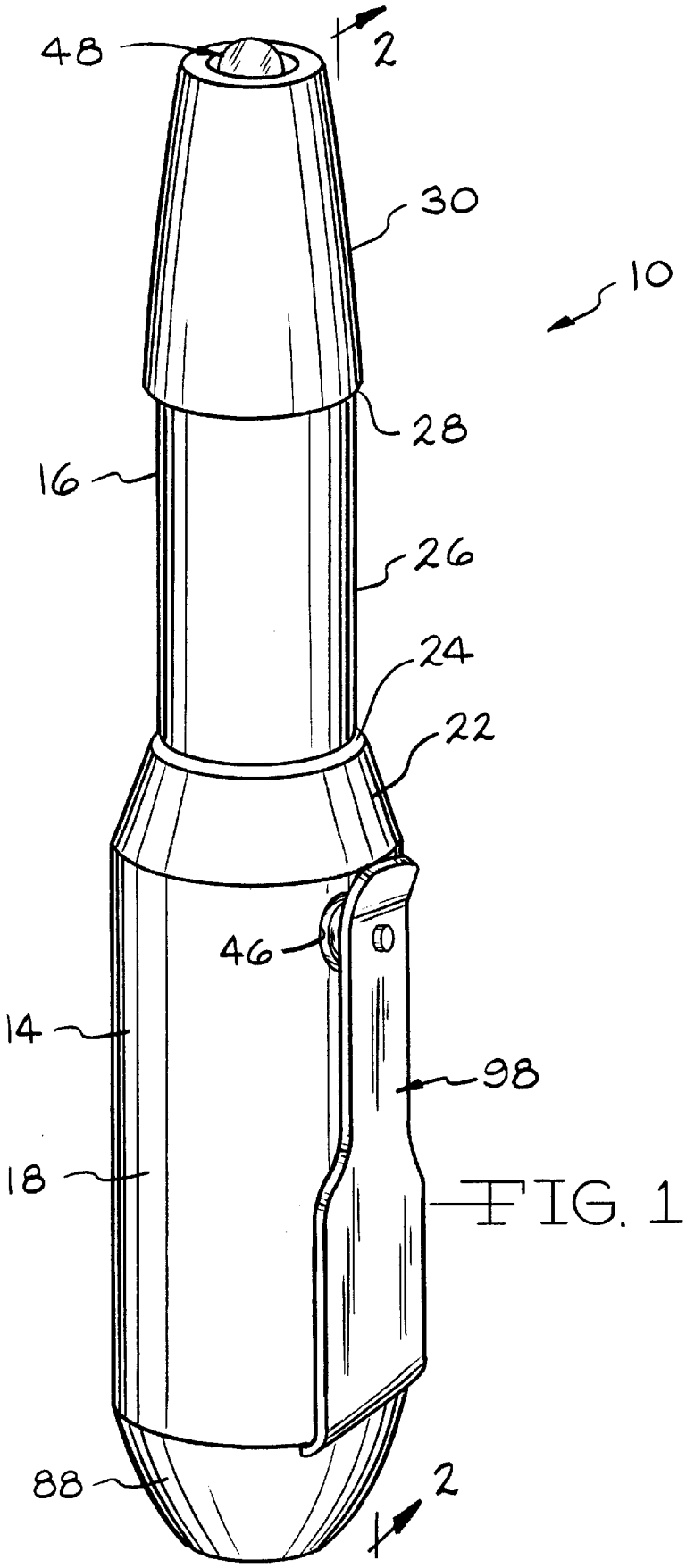
FIG. 1 is a perspective view of a penlight 10 according to the present invention.
Figure 2:
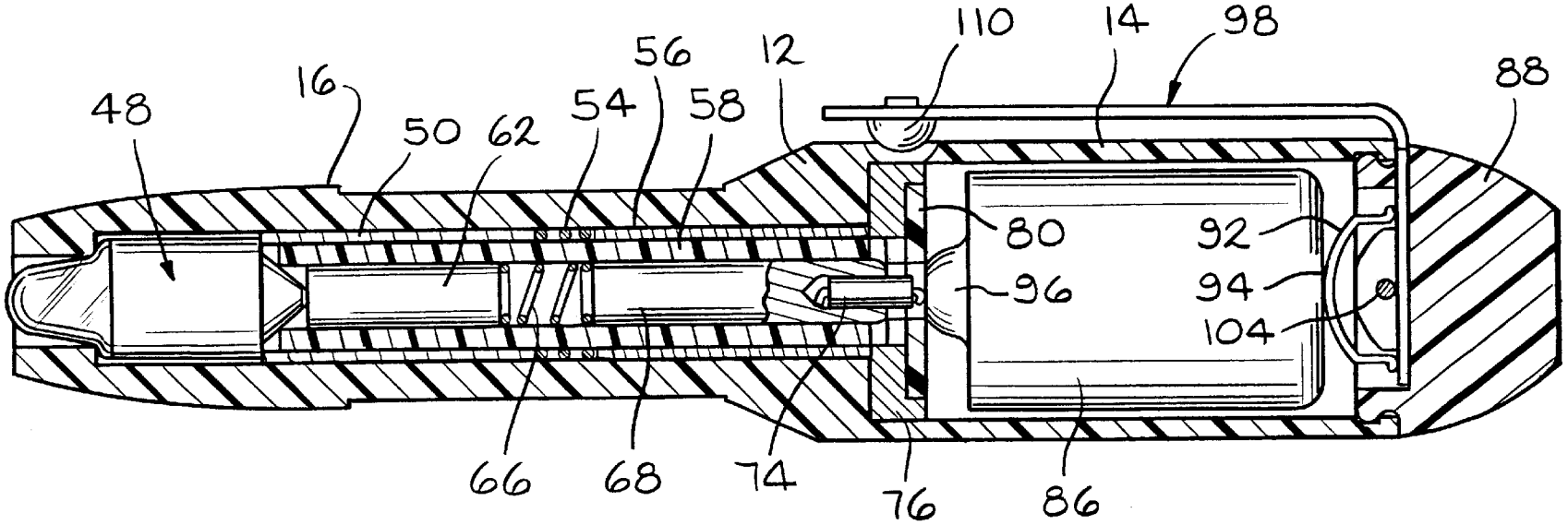
FIG. 2 is a cross-sectional view, partly in elevation, of the penlight 10 shown in FIG. 1.
Figure 3:
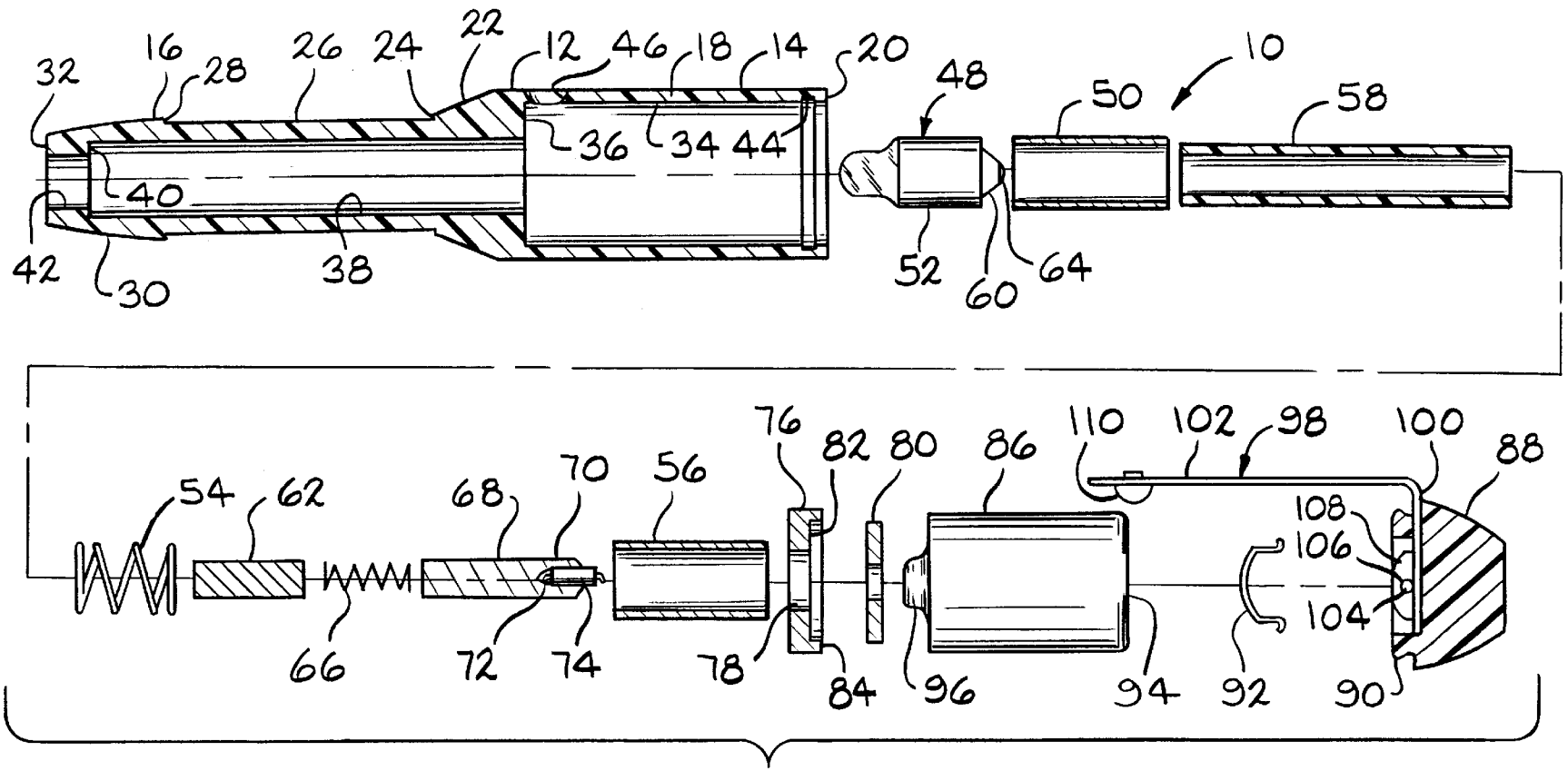
FIG. 3 is an exploded view, partly in elevation, of the penlight 10 shown in FIG. 1.

Turning now to the drawings, FIGS. 1 to 3 show a penlight 10 having low magnetic susceptibility characteristics according to the present invention comprised of a housing 12 having a handle section 14 and a forward section 16 extending distally from the handle. The housing 12 is of a non-magnetic material, preferably of an acetal compound such as DELRIN. The handle 14 comprises a tubular side wall 18 extending from an end wall 20 surrounding a proximal opening and having a cylindrical outer surface leading to a frusto-conical portion 22 that tapers downwardly along the longitudinal axis of the housing 12 to a reduced diameter step 24 of the forward section 16. The step 24 meets a first, cylindrical section 26 extending to an increased diameter step 28 meeting a second, gradually curved section 30 that terminates at forward end wall 32. The cylindrical section 26 between the steps 24 and 28 provides a recess for mounting a product label (not shown) and the like.

The interior of the tubular side wall 18 provides a first, cylindrically-shaped bore 34 extending along a major portion of the handle 14 to a first, internal step 36 that meets a second, cylindrically-shaped bore 38 extending along a minor portion of the handle 14, along the frusto-conical section 22 and along a major portion of the forward section 16 to a second, internal step 40 that meets a third cylindrically-shaped bore 42 extending along the remainder of the forward section 16 to end wall 32. The diameter of the third bore 42 is less than that of the second bore 38 which, in turn, is less than the diameter of the first bore 34. An annular channel 44 is provided in the first, cylindrically-shaped bore 34 of the handle section 14 adjacent to end wall 20. An opening 46 having an inwardly curved surface is provided through the tubular side wall 18 adjacent to step 36.

A lamp 48 is housed in the third, cylindrically-shaped bore 42 and an adjacent part of the second bore 38, and is secured in place by a first tubular member or sleeve 50. The sleeve 50 is a conductive member, preferably made of brass, having a diameter only slightly less than that of the second bore 38. Brass is a useful material for the present invention because it has a low magnetic susceptibility. A brass that has been determined to be particularly useful with the present invention has the following composition, by weight:

| | |
|---|---|
| copper | 62 to 65% |
| cadmium | <0.02% |
| iron | <0.03% |
| lead | <0.03% |
| tin | <0.03% |
| zinc | remainder |

A brass tube (5.6 mm OD×4.5 mm ID×122.6 mm long, mass of 9.810 g) of this material showed no magnetic attraction to the static field of a GE Signa 1.5 Tesla MR imaging system. In addition, the artifact associated with the tube material were equal in size of the tube (1:1 ratio), the material exhibited little, if any, RF heating and minimal alignment torquing under the influence of the strong magnetic field of the MR scanner. For a more detailed discussion of testing performed on this brass material, reference is made to a U.S. patent application titled "Endoscope Having Low Magnetic Susceptibility" (attorney docket no. 04645.0438), which is assigned to the assignee of the present invention and incorporated herein by reference.

A lamp suitable for use with the present penlight 10 having a low magnetic susceptibility is available from The Bulb Man Inc., Buffalo, N.Y. under model no. Philips #222. A distal end of the sleeve 50 abuts the lamp housing 52 with a proximal end thereof contacted by an outer coil spring 54. The outer spring 54 is of a conductive material, preferably of beryllium copper. A second sleeve 56, similar to the first sleeve 50, abuts the other end of the outer spring 54 and extends to a proximal end flush with the first step 36.

A non-magnetic tube 58, preferably of a polymeric material, for example an acetal compound such as DELRIN, is housed inside the first tubular member 50, outer spring 54 and the second tubular member 56. A distal end of the tube 58 contacts an insulator portion 60 of the lamp 48 with a proximal end thereof flush with the end of the second, tubular member 56 and step 36.

A first contact rod 62, preferably of a conductive material such as brass, is housed inside of a distal portion of the tube 58. Rod 62 is biased in electrical association with a contact 64 of lamp 48 by an inner coil spring 66, preferably of a conductive material such as beryllium copper. The inner spring 66 in turn biases against a second contact rod 68, preferably of a conductive material such as brass, that extends along the remaining length of the non-magnetic tube 58 with a proximal portion 70 of the second rod 68 extending beyond the first step 36. An axial bore 72 is provided in the proximal portion 70 of the second contact rod 68 and serves to house a resistor 74.

A contact ring 76, preferably of a conductive material such as brass, is disposed inside the first cylindrically-shaped bore 34 of the handle section 14 abutting the first step 36 to secure the first and second conductive sleeves 50, 56 and the intermediate outer spring 54 in place. The contact ring 76 has a central opening 78 that is sized to allow passage of the tube 58 therethrough. A non-magnetic, polymeric washer 80, preferably of NYLON, is seated in an annular recess 82 of the contact ring 76, flush with an annular rim 84 thereof.

A battery 86 is housed inside the handle section 14 to provide electrical power to the lamp 48. A battery suitable for use with the present low magnetic susceptibility penlight 10 is commercially available from the Electrochem Lithium Battery Division of Wilson Greatbatch Ltd., Clarence, N.Y. under model no. BCX 11 72 1/2A-LMS. This battery utilizes the lithium/thionyl chloride-bromine chloride (Li/BCX) couple.

The assembly of the first and second sleeves 50 and 56 with the intermediate outer spring 54 and the assembly of the first and second rods 62 and 68 with the intermediate inner spring 66 each provide conductive paths from the battery 86 to the lamp 48 with the springs 54, 66 serving as dimensional compensators for lamps of inexact dimensional tolerance. Further, the springs set up eddy currents that are each detachable in the magnetic field of an MRI scanner. However, the use of two springs 54 and 66 substantially radially aligned with each other serve to cancel each other to provide a non-distorted magnetic image of the penlight 10. This is especially important when the penlight 10 is used in the vicinity of a high voltage MRI scanner.

The battery 86 is secured in place by an end cap 88 having an annular, hooked-shaped protrusion 90 that snaps into the annular channel 44 adjacent to the handle end wall 20. The end cap 88 is of a non-magnetic material, preferably an acetal compound such as DELRIN. A generally U-shaped contact spring 92, preferably of a conductive material such as silver plated beryllium copper, is fitted into the end cap 88 surrounded by the annular protrusion 90. When the end cap 88 is received in the proximal opening of the handle section 14 with the annular protrusion 90 snap fitted into the annular channel 44, the contact spring 92 biases against a negative terminal 94 of the battery 86 having its opposite, positive terminal 96 contacting the resistor 74 housed in the bore 72 of the second contact rod 68. The resistor 74 lowers the voltage delivered by the battery 86 to that which is required by the lamp 48.

The end cap 88 further supports a pocket clip 98 having a ring portion 100 and a clip arm 102. The pocket clip 98 is of a conductive material such as chrome plated beryllium copper. Chrome is very impact resistant and has a low magnetic susceptibility. Other suitable coating materials include titanium nitride and parylene. Titanium nitride is a hard ceramic coating with toughness characteristics similar to chrome and that is typically physical vapor deposited. Parylene is a physical vapor deposited polymeric coating that imparts corrosion resistance and lubricity, if required. However, it is not quiet as tough or impact resistant as chrome and titanium nitride.

The ring portion 100 of the pocket clip 98 is sized to surround an inner annular ledge (not shown) of the protrusion portion 90 of the end cap 88 and is secured in place by a non-magnetic pin 104, preferably of an acetal compound, disposed in a bore 106 extending through a central protrusion 108 so that the clip ring 100 is confined between the end cap 88 and opposed ends of the pin 104. A distal section of the clip 98 supports a contact 110, preferably of a conductive material such as chrome plated beryllium copper, that is aligned with the opening 46 in the side wall 18 of the handle section 14.

In use, the lamp 48 is energized by moving the clip arm 102 towards the handle 14 so that the contact 110 moves through the opening 46 into contact with ring 76. This completes the electrical circuit from the positive terminal 96 of the battery 86 through resister 74, contact rod 68, inner spring 66, contact rod 62 and contact 64 of lamp 48 to energize the lamp's filaments (not shown) and back to the lamp housing 52 and first sleeve 50, outer spring 54 and second sleeve 56 to contact ring 76, contact 110, the pocket clip 98 to contact spring 92 and back to the negative terminal 94 of the battery 86. When the penlight 10 is not in use, the pocket clip 98 provide a convenient structure for carrying the light clipped to the pocket of a physician or like medical personnel.

In accordance with the stated low magnetic suceptibility characteristics of the penlight 10 of the present invention, Table 1 lists the magnetic susceptibilities of the various materials used to construct the penlight along with selected other materials.

TABLE 1

| Material | Density (g/cc) | Atomic or Molecular Weight | Susceptibility ($\times 10^6$) |
|---|---|---|---|
| Carbon (polycrystalline graphite) | 2.26 | 12.011 | −218 |
| Gold | 19.32 | 196.97 | −34 |
| Beryllium | 1.85 | 9.012 | −24 |
| Silver | 10.50 | 107.87 | −24 |
| Carbon (diamond) | 3.513 | 12.011 | −21.8 |
| Zinc | 7.13 | 65.39 | −15.7 |
| Copper | 8.92 | 63.546 | −9.63 |
| Water (37° C.) | 1.00 | 18.015 | −9.03 |
| Human Soft Tissues | ~1.00–1.05 | — | ~(−11.0 to −7.0) |
| Air (NTP) | 0.00129 | 28.97 | +0.36 |
| Stainless Steel (non-magnetic, austenitic) | 8.0 | — | 3520–6700 |
| Chrome | 7.19 | 51.996 | 320 |

It is known that brass is an alloy of copper and zinc.

In contrast, Table 2 lists the magnetic susceptibilities of various relatively highly magnetic materials.

TABLE 2

| Material | Density (g/cc) | Atomic or Molecular Weight | Susceptibility |
|---|---|---|---|
| Nickel | 8.9 | 58.69 | 600 |
| Stainless Steel (magnetic, martensitic) | 7.8 | — | 400–1100 |
| Iron | 7.874 | 55.847 | 200,000 |

The data used to construct Tables 1 and 2 was obtained from a paper authored by John Schneck of General Electric Corporate Research and Development Center, Schenectady, N.Y. 12309, entitled "The Role of Magnetic Susceptibility In Magnetic Resonance Imaging: Magnetic Field Compatibility of the First and Second Kinds". The disclosure of that paper is incorporated herein by reference.

Thus, the penlight of the present invention is an instrument which is useful for pre- and post-clinical and surgical applications, especially in an environment proximate the strong magnetic field emitted by a magnetic resonance imaging (MRI) scanner.

It is appreciated that various modifications to the inventive concepts described herein may be apparent to those of ordinary skill in the art without departing from the spirit and scope of the present invention as defined by the appended claims.

What is claimed is:

1. A flashlight, which comprises:

a) a housing;

b) a lamp;

c) a battery housed inside the housing to electrically energize the lamp, wherein the battery has a first terminal and a second, opposite polarity terminal;

d) a first electrically conductive path connecting between the first terminal and the lamp; and e) a second electrically conductive path connecting between the second terminal and the lamp, wherein when at least one of the first and second electrically conductive paths is open, the lamp is in an unenergized state and wherein when the at least one open conductive path is closed, the first and second electrically conductive paths are completed to thereby energize the lamp, and wherein at least one of the first and second electrically conductive paths comprise at least a first spring intermediate either a first and a second electrically conductive rods or a first and a second electrically conductive sleeves extending between the lamp and one of the first and second terminals of the battery.

2. The flashlight of claim 1 wherein at least a portion of the first and the second electrically conductive path is of brass.

3. The flashlight of claim 2 wherein the brass is composed of, by weight, about 62 to 65% copper, <0.02% cadmium, <0.03% iron, <0.03% lead, <0.03% tine, remainder zinc.

4. The flashlight of claim 1 wherein at least one of the first and second terminals of the battery are centered along a longitudinal axis of the battery.

5. The flashlight of claim 1 wherein the battery is an alkali metal battery.

6. The flashlight of claim 1 wherein the first electrically conductive path comprises the first spring intermediate the first and second rods.

7. The flashlight of claim 1 wherein the second electrically conductive path comprises a second spring intermediate the first and second sleeves.

8. The flashlight of claim 1 wherein the first electrically conductive path comprises the first spring intermediate the first and second rods, and the second electrically conductive path comprises a second spring intermediate the first and second sleeves.

9. The flashlight of claim 8 wherein the first and the second springs are coil springs.

10. The flashlight of claim 8 wherein a non-conductive member is disposed between the first electrically conductive path comprising the first spring and the first and the second rods, and the second electrically conductive path comprising the second spring and the first and the second sleeves.

11. The flashlight of claim 10 wherein the first and second springs are substantially radially aligned with each other.

12. The flashlight of claim 1 wherein the first and the second battery terminals are disposed along a longitudinal axis of the battery and the housing.

13. The flashlight of claim 12 wherein the first electrically conductive path connects between the lamp and a positive battery terminal, and the second electrically conductive path connects between the lamp and the negative battery terminal.

14. The flashlight of claim 1 wherein the battery is a lithium/thionyl chloride-bromine chloride battery.

15. A flashlight, which comprises:

a) a housing;

b) a lamp;

c) a battery housed inside the housing to electrically energize the lamp, wherein the battery has a first terminal and a second, opposite polarity terminal;

d) a first electrically conductive path connecting between the first terminal and the lamp; and e) a second electrically conductive path connecting between the second terminal and the lamp, wherein when at least one of the first and second electrically conductive paths is open, the lamp is in an unenergized state and wherein when the at least one open conductive path is closed, the first and second electrically conductive paths are completed to thereby energize the lamp, and wherein at least one of the first and second electrically conductive paths comprise at least a first spring intermediate either a first and second electrically conductive rods or a first and second electrically conductive sleeves extending between the lamp and one of the first and second terminals of the battery, wherein the battery is an alkali metal battery sealed inside of an austenitic stainless steel casing having a magnetic susceptibility of about $6{,}700\times10^{6}$ or less and wherein the internal electrical battery components, the housing, the first and second electrically conductive paths and the lamp have magnetic susceptibilities at least as low as that of austenitic stainless steel.

16. The flashlight of claim 15 wherein the first electrically conductive path comprises the first spring intermediate the first and second electrically conductive rods.

17. The flashlight of claim 15 wherein the housing is of an acetal compound.

18. The flashlight of claim 15 wherein the first electrically conductive path is either of brass or beryllium copper.

19. The flashlight of claim 15 wherein the second electrically conductive path is either of brass or beryllium copper.

20. The flashlight of claim 15 wherein at least an external portion of at least one of the first and the second electrically conductive paths is comprised of beryllium copper plated with a material selected from the group consisting of chrome, titanium nitride and parylene, and mixtures thereof.

21. The flashlight of claim 15 wherein the battery is an alkali metal battery.

22. The flashlight of claim 15 wherein the battery is a lithium/thionyl chloride-bromine chloride battery.

23. The flashlight of claim 15 as a penlight.

24. A method for assembling a flashlight, comprising the steps of:

a) providing a housing;

b) housing a lamp inside the housing as a light source;

c) providing a battery inside the housing to electrically energize the lamp, wherein the battery has a first terminal and a second, opposite polarity terminal;

d) providing a first electrically conductive path connecting between the first terminal and the lamp; and e) providing a second electrically conductive path connecting between the second terminal and the lamp, wherein when at least one of the first and second electrically conductive paths is open, the lamp is in an unenergized state and wherein when the at least one open conductive path is closed, the first and second electrically conductive paths are completed to thereby energize the lamp, and wherein at least one of the first and second electrically conductive paths comprise at least a first spring intermediate either a first and second electrically conductive rods or a first and second electrically conductive sleeves extending between the lamp and one of the first and second terminals of the battery.

25. The method of claim 24 including providing at least a portion of the first and the second electrically conductive path of brass.

26. The method of claim 25 including providing the brass composed of, by weight, about 62 to 65% copper, <0.02% cadmium, <0.03% iron, <0.03% lead, <0.03% tine, remainder zinc.

27. The method of claim 24 including providing the first electrically conductive path comprising the first spring intermediate the first and second rods.

28. The method of claim 24 including providing the second electrically conductive path comprising a second spring intermediate the first and second sleeves.

29. The method of claim 24 including providing the first electrically conductive path comprising the first spring intermediate the first and second rods, and the second spring intermediate the first and second sleeves.

30. The method of claim 29 including substantially radially aligning the first spring with the second spring.

31. The method of claim 29 including providing the first and the second springs as coil springs.

32. The method of claim 29 including disposing a non-conductive member between the first electrically conductive path comprising the first spring and the first and the second rods, and the second electrically conductive path comprising the second spring and the first and the second sleeves.

33. The method of claim 24 including providing the battery as an alkali metal battery.

34. A method for assembling a flashlight, comprising the steps of:

a) providing a housing;

b) housing a lamp inside the housing as a light source;

c) providing a battery housed inside the housing to electrically energize the lamp, wherein the battery has a first terminal and a second, opposite polarity terminal;

d) providing a first electrically conductive path connecting between the first terminal and the lamp; and e) providing a second electrically conductive path connecting between the second terminal and the lamp, wherein when at least one of the first and second electrically conductive paths is open, the lamp is in an unenergized state and wherein when the at least one open conductive path is closed, the first and second electrically conductive paths are completed to thereby energize the lamp, and wherein at least one of the first and second electrically conductive paths comprise at least a first spring intermediate either a first and second electrically conductive rods or a first and second electrically conductive sleeves extending between the lamp and one of the first and second terminals of the battery, wherein the battery is an alkali metal battery sealed inside of an austenitic stainless steel casing having a magnetic susceptibility of about $6{,}700\times10^{6}$ or less and wherein the internal electrical battery components, the housing, the first and second electrically conductive paths and the lamp have magnetic susceptibilities at least as low as that of austenitic stainless steel.

35. The method of claim 34 including providing the first electrically conductive path comprising the first spring intermediate the first and second electrically conductive rods, and the second electrically conductive path comprises a second spring intermediate the first and second electrically conductive sleeves.

36. The method of claim 34 including providing the housing of an acetal compound.

37. The method of claim 34 including providing the first electrically conductive path of either brass or beryllium copper.

38. The method of claim 34 including providing the second electrically conductive path of either brass or beryllium copper.

39. The method of 34 including providing at least an external portion of at least one of the first and the second electrically conductive paths comprised of beryllium copper plated with a material selected from the group consisting of chrome, titanium nitride and parylene, and mixtures thereof.

40. The method of claim 34 including providing the battery as an alkali metal battery.

* * * * *